United States Patent [19]

Freeman

[11] Patent Number: 5,038,414

[45] Date of Patent: Aug. 13, 1991

[54] FULL BODY HOSIERY GARMENT

[76] Inventor: Lee A. Freeman, P.O. Box 4623, Bisbee, Ariz. 85603

[21] Appl. No.: 413,270

[22] Filed: Sep. 27, 1989

[51] Int. Cl.[5] ..... A41B 11/14

[52] U.S. Cl. ..... 2/409; 2/78 A; 2/73; 66/178 A

[58] Field of Search ..... 2/75, 80, 117, 79, 70, 2/71, 73, 78 A, 113, 114, 69, 79, 227, 409, 268; 66/178 R

[56] References Cited

U.S. PATENT DOCUMENTS

| | | | |
|---|---|---|---|
| 593,175 | 11/1897 | Heyman | 2/113 X |
| 1,225,945 | 5/1917 | Feunstein | 2/78 |
| 1,232,068 | 7/1917 | Nash | 2/73 X |
| 1,303,663 | 5/1919 | Hatch | 2/78 A |
| 1,439,100 | 12/1922 | Hatch | 2/78 A |
| 1,469,858 | 10/1923 | Van Heusen | 2/229 |
| 1,633,972 | 6/1927 | Berry | 2/78 |
| 2,010,345 | 8/1935 | Brewster | 2/112 |
| 2,062,596 | 12/1936 | Monette | 2/70 |
| 2,562,234 | 7/1951 | Goltschalk | 2/117 |
| 2,664,570 | 1/1954 | Artzt | 2/78 |
| 2,685,691 | 8/1954 | Artz | 2/113 X |
| 2,707,284 | 5/1955 | Artzt | 2/113 X |
| 2,728,080 | 12/1955 | Beard | 2/113 |
| 2,803,823 | 8/1957 | Broadwin | 2/71 X |
| 3,050,734 | 8/1962 | Dopyera | 2/268 |
| 3,128,475 | 4/1964 | Rice et al. | 2/227 |
| 3,956,774 | 5/1976 | Spaulding | 2/79 |
| 4,213,312 | 7/1980 | Safrit et al. | 2/409 X |
| 4,575,874 | 3/1986 | Johnson | 2/268 |
| 4,612,935 | 9/1986 | Greifer | 2/268 X |
| 4,622,699 | 11/1986 | Spriggs | 2/114 |
| 4,627,111 | 12/1986 | Storie | 2/69 |
| 4,764,988 | 8/1988 | Reaver | 2/268 |
| 4,795,399 | 1/1989 | Davis | 2/268 X |

FOREIGN PATENT DOCUMENTS

| | | | |
|---|---|---|---|
| 1435984 | 1/1970 | Fed. Rep. of Germany | 2/79 |
| 1204184 | 1/1960 | France | 2/79 |
| 1458225 | 11/1966 | France | 2/70 |
| 2467557 | 5/1981 | France | 2/79 |

OTHER PUBLICATIONS

Hosiery and Underwear, Jun. 1969, p. 22.

*Primary Examiner*—Werner H. Schroeder
*Assistant Examiner*—Jeanette E. Chapman
*Attorney, Agent, or Firm*—Trask, Britt & Rossa

[57] ABSTRACT

The present invention provides a full body hosiery garment. The garment contains a panty portion and two tubular leg portions with adjoining foot portions. The panty, leg, and foot portions are formed of spun nylon or other pantyhose material. An upper camisole portion is connected to the panty portion to provide a smooth contour with the panty portion to define a non-binding waist area.

11 Claims, 4 Drawing Sheets

FULL BODY HOSIERY GARMENT

BACKGROUND OF THE INVENTION

1. Field

The present invention is directed toward a hosiery garment, and particularly one which extends over the upper torso.

2. State of the Art

Before the introduction of currently available pantyhose, "nylon stockings" or "nylons" were a commonly worn hosiery garment. The standard material from which hosiery garments are made is spun nylon. A problem with nylon stockings is that some means is necessary to hold them up. In pantyhose, however, the stockings are formed integral with a panty, which keeps the stockings from falling down.

In order for the panty portion of pantyhose to perform its function of holding the pantyhose up, it must be fairly tight and typically include reinforced elastic material. In addition, they have an elasticized, and fairly tight waistband, designed to go over the hips and around the waist. Without this tight waistband, the panty portion of the pantyhose would likely not have sufficient strength to keep the stocking portions from falling down.

A problem with an elasticized waistband, however, is that it distorts the appearance of the wearer's figure. The waistband causes an indention in the tissue around the waist, which can be easily noticed, even under the wearer's clothing. In addition, the tight waistband can be uncomfortable, causing a binding sensation.

A type of garment that covers essentially the upper and lower torso is one known as a "body blouse." Body blouses are designed mainly for exercising. Body blouses include an upper body portion and leg portions that extend to approximately the ankle area. This type of garment is typically formed of a material commonly known as Lycra or Spandex, which has been widely used in swimsuits and cycling shorts. Lycra is relatively thick, insulative, and opaque compared to standard hosiery material.

There remains a need for a hosiery garment that provides for adequate support for the stocking portions of the garment, and yet which avoids a binding waistband.

SUMMARY OF THE INVENTION

The present invention provides a hosiery garment comprising a panty portion formed of hosiery material, this panty portion being configured and adapted to cover the lower torso of a wearer. Two tubular leg portions are connected to the panty portion and are formed of knit hosiery material to define a pair of hosiery stockings. A camisole portion formed of stretchy, close-fitting material is connected to the panty portion at about the waist area and extending over the upper torso to form a smooth contour with the panty portion to define a non-binding waist area. The hosiery garment preferably includes a pair of feet portions configured and adapted to receive the feet of a wearer.

The camisole portion is preferably formed as a tank top having shoulder straps. These shoulder straps may additionally be padded. In one embodiment, the padding in the shoulder pads is removable. The camisole portion may be formed of a knitted blend of cotton and a stretchy synthetic material. In a preferred embodiment, the camisole portion is formed of an inexpensive disposable material. In another embodiment, the camisole is formed of knit hosiery material integral with the panty portion.

Hosiery garments of the invention provide a hosiery garment without a binding waistband. The upper camisole portion aids in holding up the hosiery stocking portions and forms a smooth contour at the waist area with the panty portion of the garment to improve the appearance of the garment and the comfort to the wearer.

DETAILED DESCRIPTION OF THE ILLUSTRATED EMBODIMENT

Figure 1:
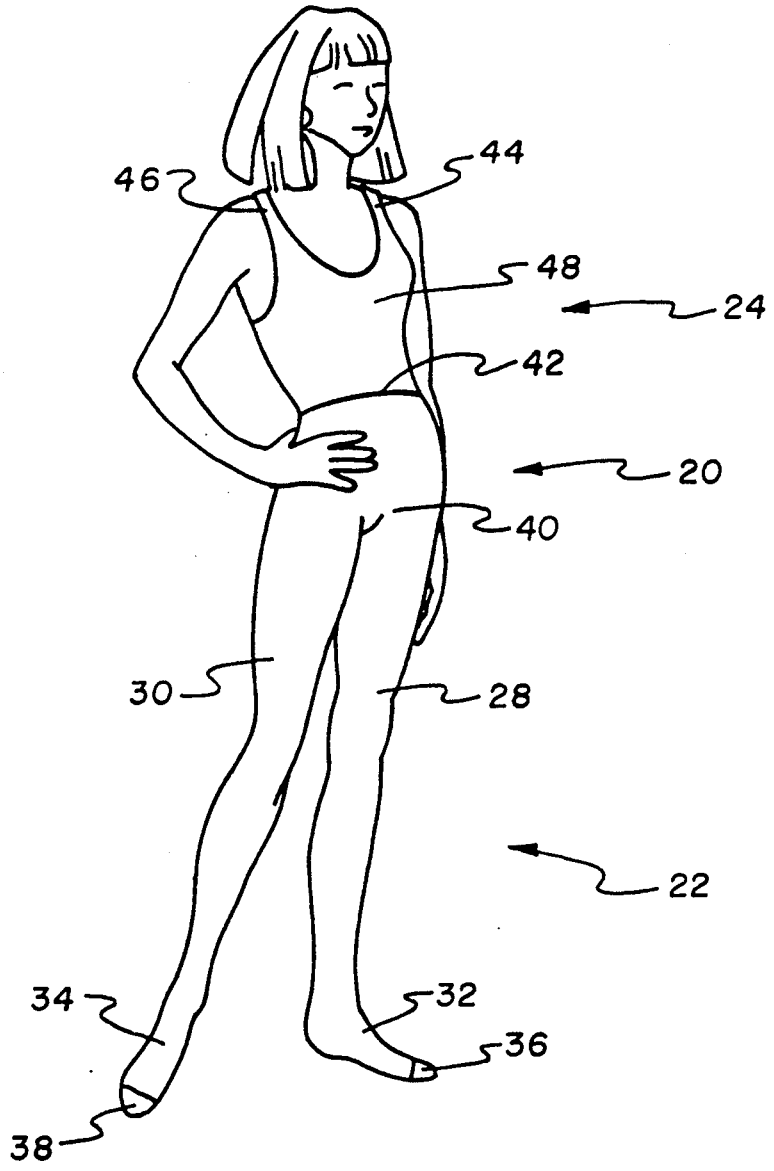
FIG. 1 is a perspective illustration of a person wearing a full body hosiery garment of the invention.
Figure 2:
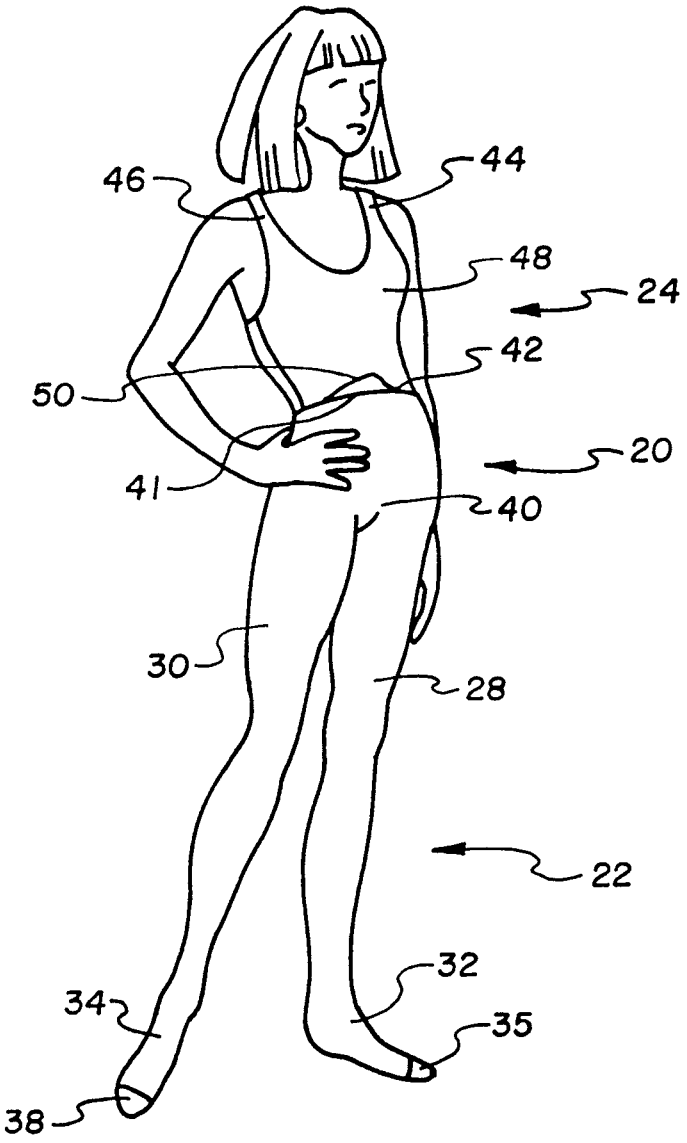
FIG. 2 is a perspective view illustrating an alternative embodiment of the invention wherein the top portion is a camisole.
Figure 3:
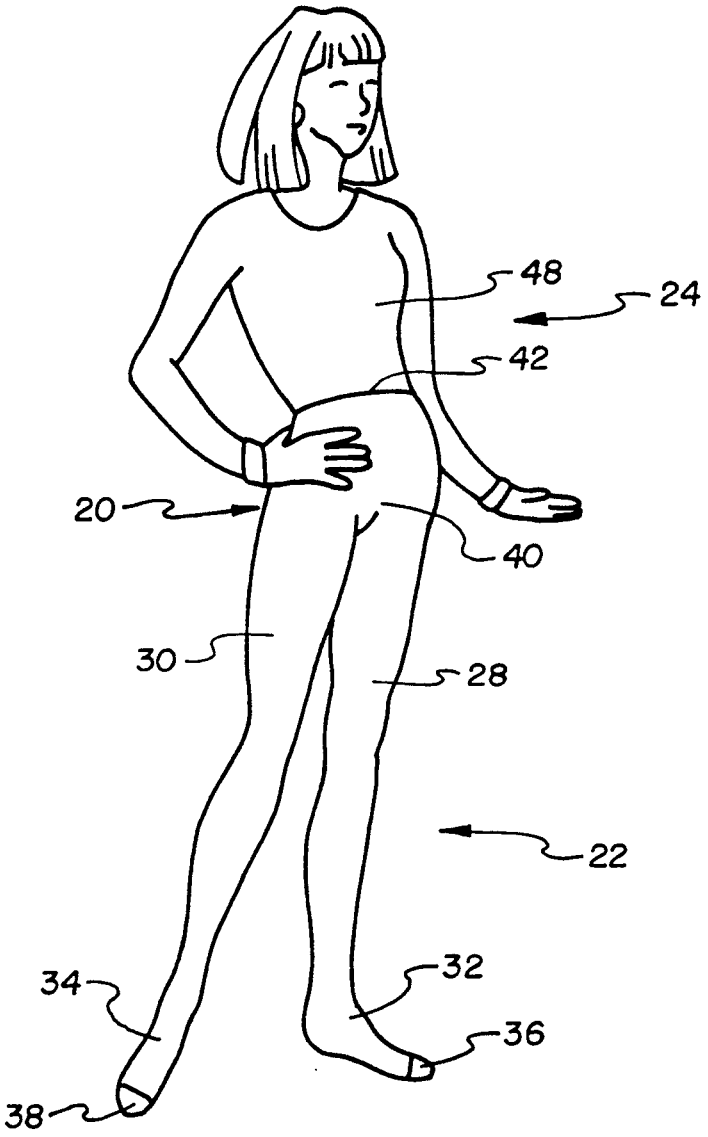
FIG. 3 is a perspective view illustrating an alternative embodiment of the invention wherein the top portion is blouse-like in construction.
Figure 4:
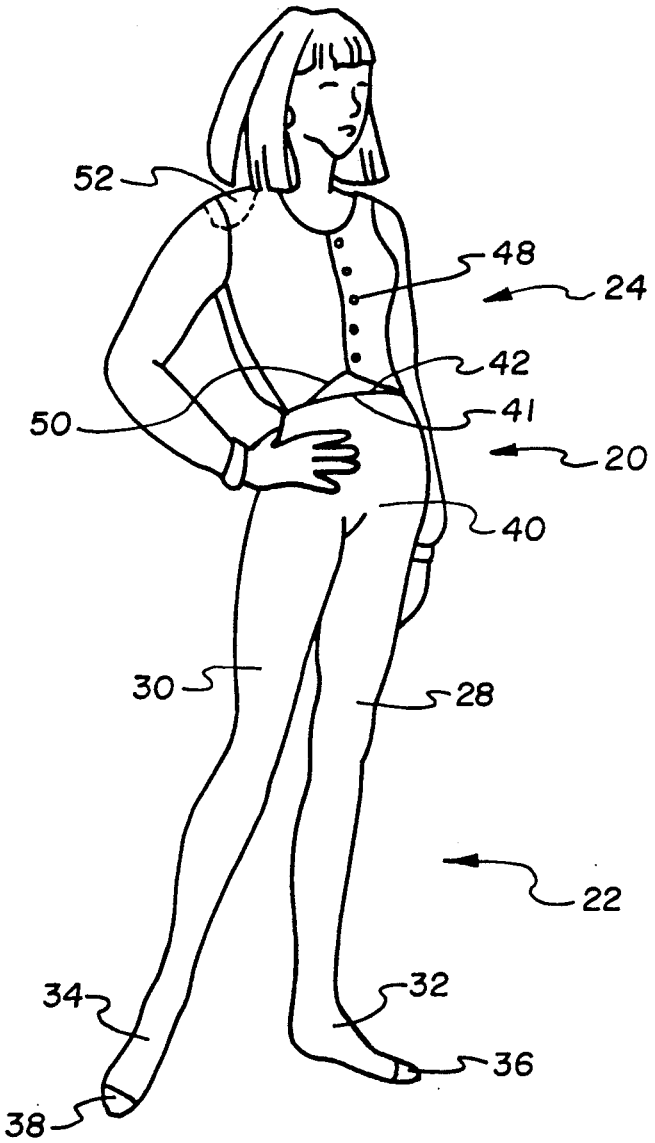
FIG. 4 is a perspective view of an alternative embodiment of the invention illustrating a blouse-like top portion.

Referring to FIG. 1, a full body hosiery garment of the invention includes a panty portion generally indicated at 20, stocking portions generally indicated at 22, and camisole portion generally indicated at 24.

The panty portion 20 and stocking portions 22 are similar to a standard pantyhose construction. Portions 20 and 22 are formed of spun nylon material used in making pantyhose. The material may be of an inexpensive disposable quality. Alternatively, portions 20 and 22 may be formed as "support hosiery," which provides additional support and has less tendency to run. The hosiery material may include, particularly in the panty portion, additional resilient or elastic material. Hosiery material is typically less than about 1 ounce per square yard, preferably between about 0.2 to about 0.8 ounce per square yard. The material is preferably sheer or nearly transparent. Portions of the garment formed of spun nylon may be advantageously knit as a single unit, rather than being cut and sewn together.

This material may be compared to other more heavy and bulky materials, such as Lycra, which typically weighs about four to seven ounces per square yard and is relatively insulative and opaque. Such a heavyweight material is suited for use in cycling shorts and swimsuits. However, it is unsuited for use in hosiery, because of its weight, bulk, opaqueness, and insulative characteristics. Hosiery material, on the other hand, is light in weight and nearly transparent to provide for a sheer yet supportive garment without being excessively insulative.

As shown, stocking portion 22 includes two tubular leg or hose members 28 and 30, foot portions 32 and 34, including toe portions 36 and 38. Toe portions 36 and 38 are reinforced to prevent rupture to occur at these high stress areas. Panty 20 includes a lined crotch area 40, lined with cotton or other appropriate lining material.

Camisole portion 24 is preferably formed of a lightweight cotton and synthetic fiber combination, preferably a blend of cotton and nylon. Camisole 24 is formed of a cotton blend to allow it to be cool and breathable, so that it can be worn under clothing. Camisole 24 may be constructed by conventional knitting methods which produce a seamless top, similar to the method of knitting used to produce the tubular leg portions of the garment. Camisole 24 may therefore be formed by typical cut-and-sew methods, cut from flat material and sewn in the desired shape. Camisole 24 may be made as a "tank top" with shoulder straps. A tank top is more adapted for wear under other clothing. Alternatively, camisole 24 may be formed as a standard blouse with sleeves. When camisole 24 is formed as a standard blouse, it may be constructed for outer wear and may be manufactured of any appropriate and conventional material from which blouses are made, including cotton, cotton blends, natural fibers, and synthetic material.

Alternatively, camisole 24 may be knitted as an integral unit with lower torso portion 20 and tubular leg portions 28 and 30, and may be formed of the same spun nylon these other portions are formed of. Because of the insulative characteristics of spun nylon, such camisoles would be more comfortable during colder weather. Embodiments which utilize spun nylon in both the camisole and the pantyhose portion may serve to provide a particularly sleek and unconstricted appearance to the pantyhose.

Camisole 24 may be formed of an inexpensive material designed to be disposable. If a run develops in the stocking portions 22, the entire garment would thus be disposed of. In embodiments in which the stocking portions are formed to be support hosiery, in which the stocking portions may be more expensive and have less of a tendency to run, camisole 24 may be formed of a higher-quality and more expensive material.

In embodiments in which camisole 24 is formed of materials other than spun nylon, it must be connected in some fashion to panty 20 along an upper edge 41 thereof. In the embodiment of FIG. 1, this is preferably done by a sewing technique, producing seam 42. No elastic waistband is formed at seam 42, which is at the position of a standard waistband of pantyhose. Camisole 24 is sewn to panty 20 to provide a smooth contour between panty 20 and camisole 24 in a fashion to avoid any binding waistband or indentation of the wearer's tissue at the waist level.

Since there is no elastic waistband at the waistline, camisole 24 serves to hold panty 20 and tubular leg portions 28 and 30 up and in place. Therefore, shoulder straps 44 and 46 are preferably padded with an appropriate padding material such as cotton or terrycloth to help keep shoulder straps 44 and 46 from exerting concentrated strain on the wearer's shoulders. These shoulder pads may be formed integral with the straps 44 and 46. Alternatively, they may be made to be removable, such as with hook-and-loop strips, i.e., Velcro. Because of the elastic characteristics of spun nylon, shoulder pads may be more important for comfort in embodiments having a camisole formed of spun nylon. Padding 52 in the area of the shoulders may also be desireable when camisole 24 is in the form of a standard blouse.

Additionally, the breast area 48 of camisole 24 may be reinforced, similar to the manner of reinforcement of swimsuit top, to provide support to the female wearer's breasts. An underwire bra, or a typical support bra may be made directly into the breast area of the camisole top, for reinforcement. Such support may be particularly advantageous when the garment is worn for exercising.

At seam 42, a fastener, such as hook and loop strips or snaps may be provided to allow panty 20 to be partly or completely separated from camisole 24 between the lower edge 50 of the camisole 24 and the upper edge 41 of the panty 20. Such a provision would allow the wearer to use the restroom without having to remove camisole 24 completely.

Thus, the full body pantyhose of the invention provides an undergarment which provides a pantyhose-type hosiery garment, but which avoids the need and disadvantages of a tight elasticized waistband. The garment provides for a sleeker, more attractive appearance and is more comfortable to wear.

Reference herein to details of the illustrated embodiment is not intended to limit the scope of the appended claims, which themselves recite those features considered important to the invention.

I claim:

1. A hosiery garment, comprising:

a panty member formed of stretchy knit hosiery material to receive the lower torso of a wearer, said panty member having an upper edge;

a pair of leg members formed of sheer, transparent knit hosiery material and depending from said panty member;

a pair of foot members formed of sheer, transparent knit hosiery material connected respectively to said leg members to receive the feet of a wearer; and an upper body portion having a lower edge connected to said upper edge of said panty member, said upper body portion extending over the shoulders of a wearer and configured to provide non-binding construction with said panty member at the waist area of said wearer.

2. A hosiery garment according to claim 1 wherein said upper body portion is a tank top having unitary, seamless construction and shoulder straps.

3. A hosiery garment according to claim 2 wherein said tank top is connected to said upper edge of said panty member by means providing detachability of said tank top from said panty member.

4. The hosiery garment according to claim 1 wherein said upper body portion is a conventional blouse having unitary, seamless construction and which is constructed for wearing as an outer garment.

5. A hosiery garment according to claim 1 wherein said upper body portion is a conventional blouse defining a garment for outer wear having a front portion, a back portion, and sleeves to cover at least a portion of the arms of said wearer.

6. The hosiery garment according to claim 5 wherein said blouse is connected to said upper edge of said panty member by means providing detachability of said blouse from said panty member.

7. The hosiery garment according to claim 6 further comprising padding secured to said blouse in the area of the wearer's shoulders.

8. A hosiery garment comprising:

a panty portion formed of sheer, transparent knit hosiery material, said panty being configured and adapted to cover the lower torso of a wearer, said panty portion further having an upper edge encircling the waist area of a wearer;

two tubular leg portions formed of sheer, transparent knit hosiery material connected to said panty portion;

an upper body portion attached to said upper edge of said panty portion and being formed from a front panel having sides and a back panel having sides, said front and back panels being stitched together at said sides, and said upper body portion being formed to cover the upper torso of the wearer.

9. A hosiery garment according to claim 8 wherein said upper body portion is detachable from said panty portion at said upper edge of said panty portion.

10. A hosiery garment according to claim 9 wherein said upper body portion is formed as a tank top having shoulder straps.

11. A hosiery garment according to claim 9 wherein said upper body portion is constructed for wearing as an outer garment and further comprises sleeve members to cover the arms of a wearer.

* * * * *